US009591929B1

(12) United States Patent
Surman

(10) Patent No.: US 9,591,929 B1
(45) Date of Patent: Mar. 14, 2017

(54) BEDDING GRIPPER, A BETTER METHOD TO MANAGE BEDDING

(71) Applicant: William Kenneth Surman, Tucson, AZ (US)

(72) Inventor: William Kenneth Surman, Tucson, AZ (US)

( * ) Notice: Subject to any disclaimer, the term of this patent is extended or adjusted under 35 U.S.C. 154(b) by 0 days.

(21) Appl. No.: 15/211,771

(22) Filed: Jul. 15, 2016

(51) Int. Cl.
*A47C 21/02* (2006.01)

(52) U.S. Cl.
CPC ..... *A47C 21/022* (2013.01); *A47C 21/02* (2013.01)

(58) Field of Classification Search
CPC ..... A47C 21/00; A47C 21/02; A47C 21/022; A47C 21/024; A47C 21/026; A47C 21/028
See application file for complete search history.

(56) References Cited

U.S. PATENT DOCUMENTS

| | | | | | |
|---|---|---|---|---|---|
| 267,498 | A | * | 11/1882 | Cox | A47C 21/022 24/265 EC |
| 561,376 | A | * | 6/1896 | Crawford | A47C 21/022 24/457 |
| 684,866 | A | * | 10/1901 | Ringdahl | A47C 21/022 24/498 |
| 728,204 | A | | 5/1903 | Coffman | |
| 763,014 | A | * | 6/1904 | Neider | A47C 21/022 24/457 |
| 806,521 | A | | 12/1905 | Childs | |
| 852,180 | A | | 4/1907 | Hoffman | |
| 1,051,560 | A | * | 1/1913 | Cowler | A47C 21/022 24/494 |
| 1,365,169 | A | | 1/1921 | Goldberg | |
| 1,950,084 | A | * | 3/1934 | Halsey | A47C 21/022 24/72.5 |
| 1,982,998 | A | * | 12/1934 | Matchett | A47C 21/022 24/521 |
| 2,321,394 | A | | 6/1943 | King | |
| 2,459,497 | A | | 1/1949 | Calabro | |
| 2,931,084 | A | | 4/1960 | De Witt | |
| 3,092,848 | A | | 6/1963 | Gronvold | |
| 3,109,181 | A | * | 11/1963 | Gilpatrick | A47C 21/022 5/498 |
| 3,832,743 | A | | 9/1974 | Smith | |
| 4,276,667 | A | | 7/1981 | Osbourne | |
| 4,541,137 | A | | 9/1985 | Murray | |
| 4,662,016 | A | | 5/1987 | Seeman | |
| 4,698,880 | A | | 10/1987 | Hamm | |

(Continued)

FOREIGN PATENT DOCUMENTS

| | | | | | |
|---|---|---|---|---|---|
| DE | 327710 | C | * | 10/1920 | A47C 21/022 |
| GB | 2247169 | A | * | 2/1992 | A47C 21/022 |
| GB | 2507167 | A | * | 2/1992 | A47C 21/02 |

*Primary Examiner* — David E Sosnowski
*Assistant Examiner* — Amanda L Miller

(57) ABSTRACT

The device presented provides a simple and secure solution to fasten unfitted bedding to a stationary section of the bed, eliminating any other need such as tucking or strapping. The grasp of the device is accomplished by the eccentric motion of the gripper. To engage the grasp, the bedding is placed in the pinch point of the device; pressure is then exerted on the lower part of the gripper to ensure contact with the bedding. To release the grasp, simply lift up the lower end of the gripper and remove the bedding. Normally two devices mounted to the rigid section of the box spring are sufficient to securely retain the bedding.

1 Claim, 1 Drawing Sheet

BEDDING GRIPPER

(56) References Cited

U.S. PATENT DOCUMENTS

Figures 1, 2:
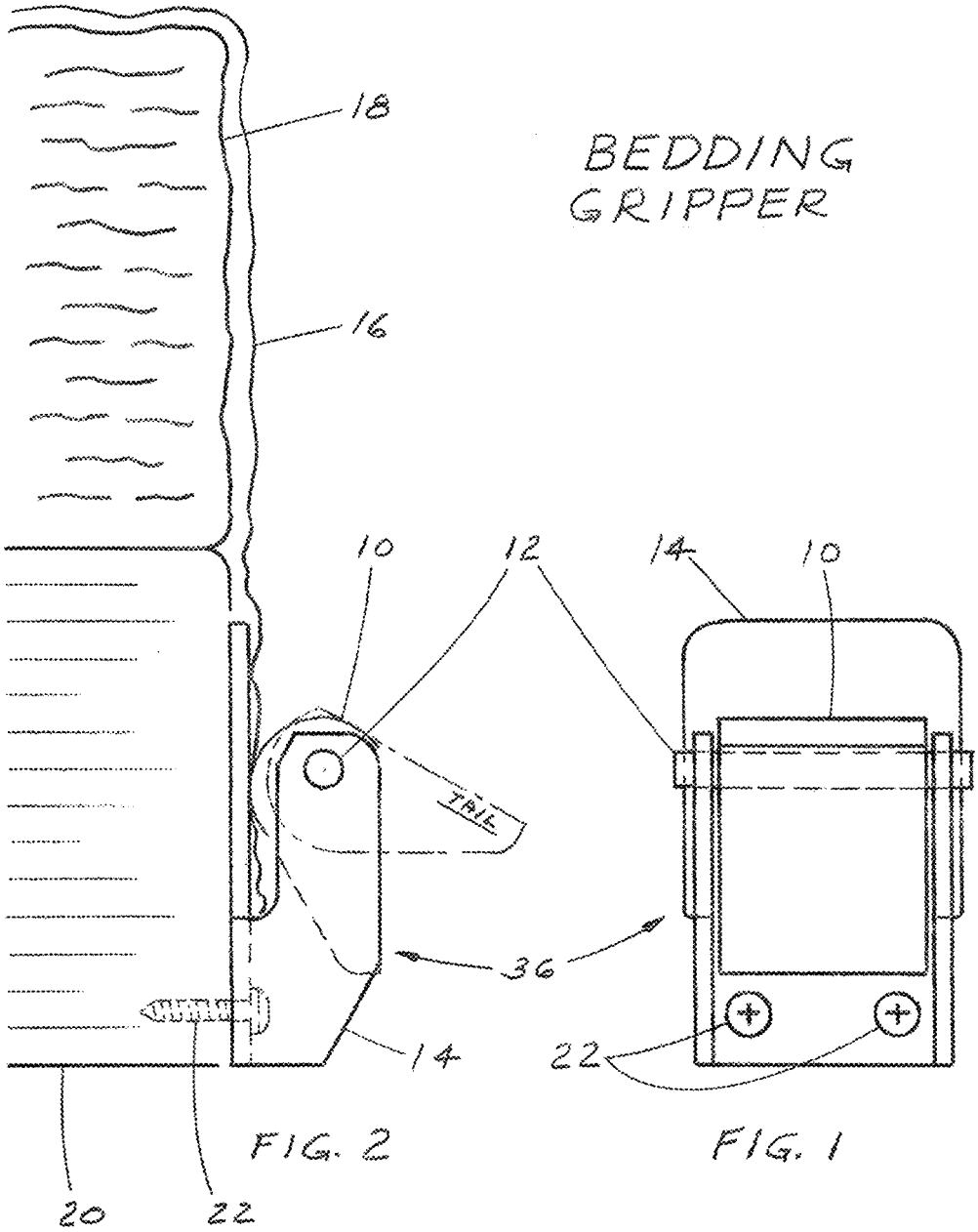

| | | | |
|---|---|---|---|
| 4,712,262 | A | 12/1987 | Viggiano |
| 4,782,543 | A | 11/1988 | Hutton |
| 4,794,660 | A | 1/1989 | Hawkrigg |
| 4,967,434 | A | 11/1990 | Hill |
| 5,014,399 | A | 5/1991 | Grisel |
| 5,092,009 | A | 3/1992 | Griffith |
| 5,099,531 | A | 3/1992 | Schmier |
| 5,377,391 | A | 1/1995 | Foster |
| 5,404,602 | A | 4/1995 | Kondo |
| 5,467,491 | A | 11/1995 | Griffith |
| 5,867,873 | A | 2/1999 | Arend |
| 6,295,670 | B1 | 10/2001 | Schieberl |
| 6,457,194 | B1 | 10/2002 | Bennett |
| 6,836,913 | B2 | 1/2005 | Perrin et al. |
| 6,907,628 | B2 | 6/2005 | El Guermani |
| 7,467,428 | B2 | 12/2008 | Hanes |
| 8,032,959 | B2 | 10/2011 | Rowson |
| 8,122,541 | B1 | 2/2012 | Georgatos |
| 8,321,975 | B1 | 12/2012 | Lindberg |
| 8,689,374 | B2 | 4/2014 | Rudd |
| 8,745,787 | B1 | 6/2014 | Heimlich |

* cited by examiner

BEDDING
GRIPPER
18
16
10
12
14
10
TRIL
36
14
22
20
22

BEDDING GRIPPER, A BETTER METHOD TO MANAGE BEDDING

CROSS-REFERENCE TO RELATED APPLICATION

This application claims the benefit of U.S. Provisional Application No. 62/284,709, filed Oct. 7, 2015, Bedding Gripper, a better method to manage bedding.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

My invention provides an easy solution to securing bedding, such as a top flat sheet, to a rigid section of the bed. The Bedding Gripper eliminates the need for tucking, strapping or any other means to hold the bedding in place, while keeping the bed orderly and much easier to maintain.

Properly mounted, the Bedding Gripper provides an easy and secure method of holding the bedding while also providing a quick release of the grip.

Similar prior art includes, U.S. Patent Numbers:

U.S. Pat. No. 728,204, Coffman.
U.S. Pat. No. 806,521, Childs.
U.S. Pat. No. 852,180, Hoffman.
U.S. Pat. No. 1,365,169, Goldberg.
U.S. Pat. No. 2,321,394, King.
U.S. Pat. No. 2,459,497, Calabro.
U.S. Pat. No. 2,931,084, De Witt.
U.S. Pat. No. 3,092,848, Gronvold.
U.S. Pat. No. 3,832,743, Smith.
U.S. Pat. No. 4,276,667, Osbourne.
U.S. Pat. No. 4,541,137, Murray.
U.S. Pat. No. 4,662,016, Seeman.
U.S. Pat. No. 4,698,880, Hamm.
U.S. Pat. No. 4,712,262, Viggiano.
U.S. Pat. No. 4,782,543, Hutton et al.
U.S. Pat. No. 4,794,660, Hawkrigg.
U.S. Pat. No. 4,967,434, Hill.
U.S. Pat. No. 5,014,399, Grisel.
U.S. Pat. No. 5,092,009, Griffith.
U.S. Pat. No. 5,009,531, Schmier.
U.S. Pat. No. 5,377,391, Foster.
U.S. Pat. No. 5,404,602, Kondo.
U.S. Pat. No. 5,467,491, Griffith.
U.S. Pat. No. 5,867,873, Arend.
U.S. Pat. No. 6,295,670 B1, Schieberl.
U.S. Pat. No. 6,457,194 B1, Bennett.
U.S. Pat. No. 6,836,913 B2, Perrin et al.
U.S. Pat. No. 6,907,628 B2, El Guermaai.
U.S. Pat. No. 7,467,428 B2, Hanes.
U.S. Pat. No. 8,032,959 B2, Rowson et al.
U.S. Pat. No. 8,122,541 B1, Georgatos.
U.S. Pat. No. 8,321,975 B1, Lindberg et al.
U.S. Pat. No. 8,689,374 B2, Rudd.
U.S. Pat. No. 8,745,787 B1, Heimlich.

The above patents are also duplicated on forms PTO/SB/08a, 2 sheets, included with this application.

BRIEF SUMMARY OF THE INVENTION

The Bedding Gripper uses the eccentric capability of the locking cam to clamp and hold the desired bedding securely in place. Once the bedding material is inserted between the loose locking cam and the frame, the grip is easily engaged by pressing down on the tail of the locking cam. The release is just as easy by lifting up on the tail of the locking cam.

BRIEF DESCRIPTION OF THE TWO VIEWS OF THE DRAWING

FIG. 1—Front view of the Bedding Gripper assembly, showing the width of the three components (the locking cam, pivot pin and frame), in relation to each other.

FIG. 2—Side view showing the Bedding Gripper assembly mounted via mounting means to a rigid or stationary bed component below the mattress. This view also illustrates the locking cam firmly clamping the bedding sheet against the frame.

REFERENCE CHARACTERS

10—locking cam
12—pivot pin
14—frame
16—bedding (sheet or any material, flexible or rigid)
18—mattress
20—rigid or stationary bed component (box spring)
22—mounting means
36—Bedding Gripper (assembly)

DETAILED DESCRIPTION OF THE INVENTION

The Bedding Gripper 36 uses the eccentric capability of the locking cam 10 to grasp and hold the desired bedding 16 or any similar material, flexible or rigid securely in place.

The three components comprising the Bedding Gripper 36 are, the locking cam 10, pivot pin 12, and frame 14. The locking cam 10 provides the clamping action due to its eccentric motion. The pivot pin 12 allows the locking cam 10 to swing freely within the frame 14 providing the proper relationship for clamping and releasing the bedding 16. The frame 14 provides the mounting for the Bedding Gripper 36, while housing the locking cam 10 via the pivot pin 12 and providing a stationary clamping surface.

The pivot pin 12 and frame 14 are made of a rigid material substantial enough for the dimensional stability needed to maintain the grip. The locking cam 10 is made of a material that provides both traction with the bedding 16 and some flexibility to compensate for minor variations in bedding 16 materials.

When properly mounted, the Bedding Gripper 36 provides a quick and easy means to stabilize bedding 16. This is accomplished by slipping the bedding 16 between the locking cam 10 and the frame 14, then press down on the tail of the locking cam 10. Any movement of the bedding 16 away from the Bedding Gripper 36 will tighten the grip of the locking cam 10 restricting any movement of the bedding 16. To release the hold of the Bedding Gripper 36, simply lift up the tail of the locking cam 10 as shown, in phantom, in FIG. 2.

Proper mounting of the Bedding Gripper 36 is achieved by securely mounting the frame 14 to a stationary component 20 of the bed. This can be attained in many ways depending on the configuration of the bed. The average bed consists of a mattress 18 atop a box spring 20, which is usually configured with a wooden structure along the base of the box spring. This wooden structure provides a convenient location to mount the frame 14 of the Bedding Gripper 36 using a pair of screws as the mounting means 22 shown in FIG. 2.

The invention claimed is:

1. A bedding gripper assembly for securing bedding to a bed comprising:

a frame comprising a substantially J-shaped portion connected to a vertical plate portion so as to form a gap therebetween;

an eccentric locking cam pivotally mounted to the substantially J-shaped portion with a pivot pin, the eccentric locking cam being pivotable between a first position and a second position, wherein at the first position the eccentric locking cam is configured to not contact and not secure bedding and at the second position the eccentric locking cam is configured to directly contact and secure the bedding between the eccentric locking cam and the vertical plate portion of the frame;

wherein in the first position a tail of the eccentric locking cam is positioned at an acute angle from a vertical surface of the substantially J-shaped portion of the frame and in the second position the tail of the eccentric locking cam extends in a plane substantially parallel to the vertical plate portion and is substantially flush with the vertical surface of the substantially J-shaped portion of the frame;

wherein the vertical surface of the substantially J-shaped portion of the frame intersects with an inclined surface of the substantially J-shaped portion to form an intersection and in the second position a distal end of the tail of the eccentric locking cam is positioned proximate to the intersection;

wherein the bedding gripper assembly further comprises a pair of fasteners extending through the vertical plate portion and configured to mount the bedding gripper assembly to a box spring or a stationary component of a bed.

* * * * *